US005964168A

United States Patent [19]

Komuro

[11] Patent Number: 5,964,168

[45] Date of Patent: Oct. 12, 1999

[54] EMBROIDERY SEWING MACHINE CONTROLLING DEVICE

[75] Inventor: Kyoji Komuro, Nagoya, Japan

[73] Assignee: Brother Kogyo Kabushiki Kaisha, Nagoya, Japan

[21] Appl. No.: 08/966,656

[22] Filed: Nov. 10, 1997

[30] Foreign Application Priority Data

Nov. 15, 1996 [JP] Japan ..... 8-305321

[51] Int. Cl.[6] ..... D05C 5/02; D05B 25/00

[52] U.S. Cl. ..... 112/102.5; 112/155; 112/445

[58] Field of Search ..... 112/102.5, 470.06, 112/445, 458, 470.01, 155; 364/470.09, 470.07

[56] References Cited

U.S. PATENT DOCUMENTS 5,253,599 10/1993 Hashiride ..... 112/102.5
5,303,665 4/1994 Hausammann ..... 112/445
5,347,940 9/1994 Hori et al. ..... 112/445 X
5,363,783 11/1994 Hori et al. ..... 112/445 X
5,694,561 12/1997 Malamud et al. ..... 345/346

*Primary Examiner*—Peter Nerbun
*Attorney, Agent, or Firm*—Oliff & Berridge, PLC

[57] ABSTRACT

There is provided an embroidery data selecting system for selecting an embroidery pattern from a plurality of embroidery patterns. The system includes: a recording medium which stores the plurality of embroidery patterns; a display having at least a first display area and a second display area; a first display controller which displays the plurality of groups in the first area, the plurality of embroidery patterns being categorized into a plurality of groups, the plurality of groups having a hierarchical structure, the hierarchical structure of the plurality of groups being visually recognizable in the first area; a manually operable member to be operated to select one of the plurality of groups displayed in the first area; and a second display controller which displays embroidery patterns included in a group in the second area in response to selection by the manually operable member.

19 Claims, 3 Drawing Sheets

EMBROIDERY SEWING MACHINE CONTROLLING DEVICE

BACKGROUND OF THE INVENTION

The present invention relates to an embroidery sewing machine controlling device which enables an operator to select one of a plurality of embroidery data representing a plurality of embroidery patterns, and controls the embroidery sewing machine in accordance with the selected embroidery data.

Conventionally, embroidery data representing embroidery patterns to be formed are stored in a recording medium such as a floppy disk. When an embroidery pattern is to be formed, the embroidery data representing the embroidery pattern is read out of a floppy disk, and the pattern is displayed on a screen of a CRT (Cathode Ray Tube), and/or the sewing machine is driven in accordance with the embroidery data.

In the conventional embroidery sewing machine controlling device, various methods have been suggested for selecting data representing a desired pattern from among the data of a plurality of embroidery patterns.

For example, the plurality of embroidery patterns may be categorized into a plurality of data groups and stored in a recording medium in the form of folders, or directories. If a folder is selected, all the pattern data included in the selected folder is read out of the recording medium, and all the patterns may be displayed in a thumb-nail format, or a small rough image of the patterns may be aligned on the display. In such a case, the operator is capable of visually selecting a desired pattern from among the displayed image of the embroidery patterns.

Generally, the data groups, i.e., folders each have a tree structure, and it is well known, in a field related to computers, that such tree structures can be displayed on the display.

In the conventional embroidery sewing machine controlling device, however, the small rough image of the patterns, or the tree structure is displayed exclusively. Therefore, if the desired pattern is not included in the displayed embroidery pattern, the operator must change the display condition so that the tree structure is displayed, in order to select another folder. Then, the embroidery patterns related to the newly selected folder are displayed. Thus, in the conventional embroidery sewing machine controlling device, the display condition should be changed between a condition where the tree structure is displayed and a condition where the embroidery patterns are displayed, and accordingly working efficiency is relatively bad.

SUMMARY OF THE INVENTION

It is therefore an object of the invention to provide an improved embroidery sewing machine controlling device with which an operator is capable of selecting a desired embroidery pattern easily.

For the object, according to an aspect of the invention, there is provided an embroidery data selecting system for selecting an embroidery pattern from a plurality of embroidery patterns, the system comprising: a recording medium which stores the plurality of embroidery patterns; a display having at least a first display area and a second display area; a first display controller which displays the plurality of embroidery patterns in the first area, the plurality of embroidery patterns being categorized into a plurality of groups, the plurality of groups having a hierarchical structure, the hierarchical structure of the plurality of groups being visually recognizable in the first area; a manually operable member to be operated to select one of the plurality of groups displayed in the first area; and a second display controller which displays embroidery patterns included in a group in the second area in response to selection by the manually operable member.

According to another aspect of the invention, there is provided an embroidery data selecting system for selecting an embroidery pattern from a plurality of embroidery patterns, the system comprising: a recording medium which stores the plurality of embroidery patterns, the plurality of embroidery patterns being categorized into a plurality of groups, the plurality of groups having a hierarchical structure; a display having at least a first display area and a second display area; a first display controller which displays the plurality of groups in the first area such that the hierarchical structure of the plurality of groups is visually recognizable; a manually operable member to be operated to select one of the plurality of groups displayed in the first area; and a second display controller which displays embroidery patterns included in a group in the second area in response to selection by the manually operable member.

According to a further aspect of the invention, there is provided an embroidery sewing machine control system for selecting one of a plurality of embroidery patterns and controlling at least one sewing machine to form an embroidery based on a selected one of the plurality of embroidery patterns, the embroidery sewing system comprising: a recording medium which stores the plurality of embroidery patterns, the plurality of embroidery patterns being categorized into a plurality of groups, the plurality of groups having a hierarchical structure; a display having at least a first display area and a second display area; a first display controller which displays the plurality of groups in the first area such that the hierarchical structure of the plurality of groups is visually recognizable; a manually operable member to be operated to select one of the plurality of groups displayed in the first area; a second display controller which displays embroidery patterns included in a group in the second area in response to selection by the manually operable member, any one of the embroidery patterns displayed in the second area being selectable by the manually operable member; and an embroidery sewing controller which controls the at least one sewing machine to form an embroidery based on the selected one of the plurality of embroidery patterns selected by the manually operable member.

As described above, since the data structure, i.e., the hierarchical structure of the groups or hierarchical relationship among the groups are visually indicated, an operator can select a desired embroidery pattern easily. Further, if the desired pattern cannot be found in a certain group, the operator can select another group relatively easily, since the currently selected group, the other groups, and the patterns corresponding to the currently selected group are displayed simultaneously.

It is preferable that any one of the embroidery patterns can be selected by the manually operable member, and wherein a detailed image of an embroidery pattern selected by the manually operable member is displayed on the display.

Optionally, each group is displayed as a folder.

Further optionally, if the selected group includes at least one group subordinate to the selected group, the at least one group subordinate to the selected group is displayed in the first area.

Preferably, a positional relationship between the plurality of groups displayed in the first area indicates the hierarchical structure among the plurality of groups.

Optionally, the embroidery data selecting system and/or the embroidery sewing machine control system may have a memory, and the selected embroidery pattern is read out of the recording medium and stored in the memory.

It should be noted that the recording medium could be a floppy disk.

Further optionally, the manually operable member comprises a mouse. Alternatively or optionally, the manually operable member could be a keyboard.

Still optionally, a displayed condition of each the plurality of groups may be changed when it is selected by the manually operable member.

DETAILED DESCRIPTION OF THE PREFERRED EMBODIMENTS

The present invention will be described with reference to the accompanying drawings.

Figure 1:
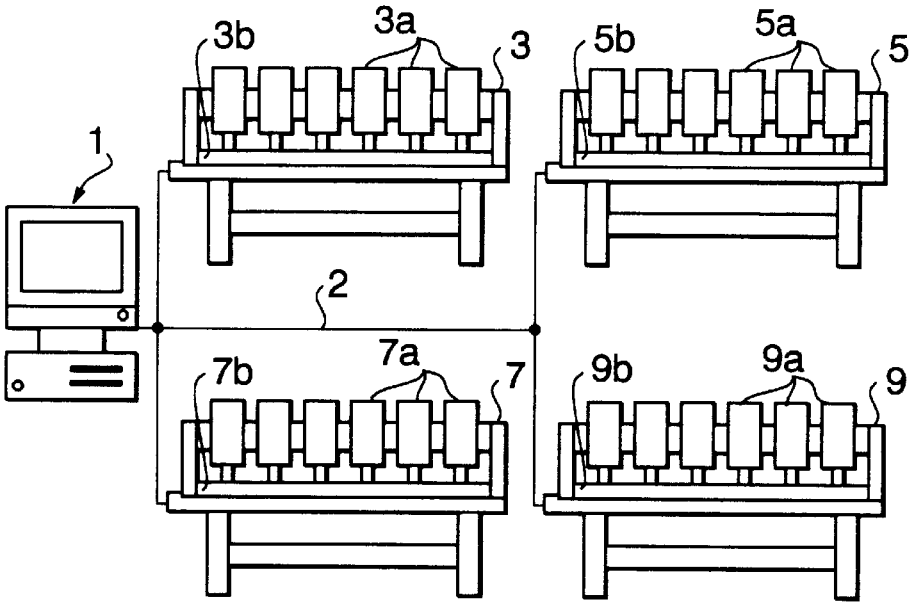
FIG. 1 shows a system configuration of an embroidery sewing machine control system according to an embodiment of the present invention.

FIG. 1 shows an embroidery sewing machine control system according to an embodiment. As shown in FIG. 1, the control system includes a personal computer 1 to which a plurality of sewing machines 3, 5, 7 and 9 are connected through cables 2. The sewing machines 3, 5, 7 and 9 each are so-called multi-head embroidery sewing machines respectively having a plurality of heads 3*a*, 5*a*, 7*a* and 9*a*, a work holding frames 3*b*, 5*b*, 7*b* and 9*b* which are used commonly among the plurality of heads 3*a*, 5*a*, 7*a* and 9*a*.

Figure 2:
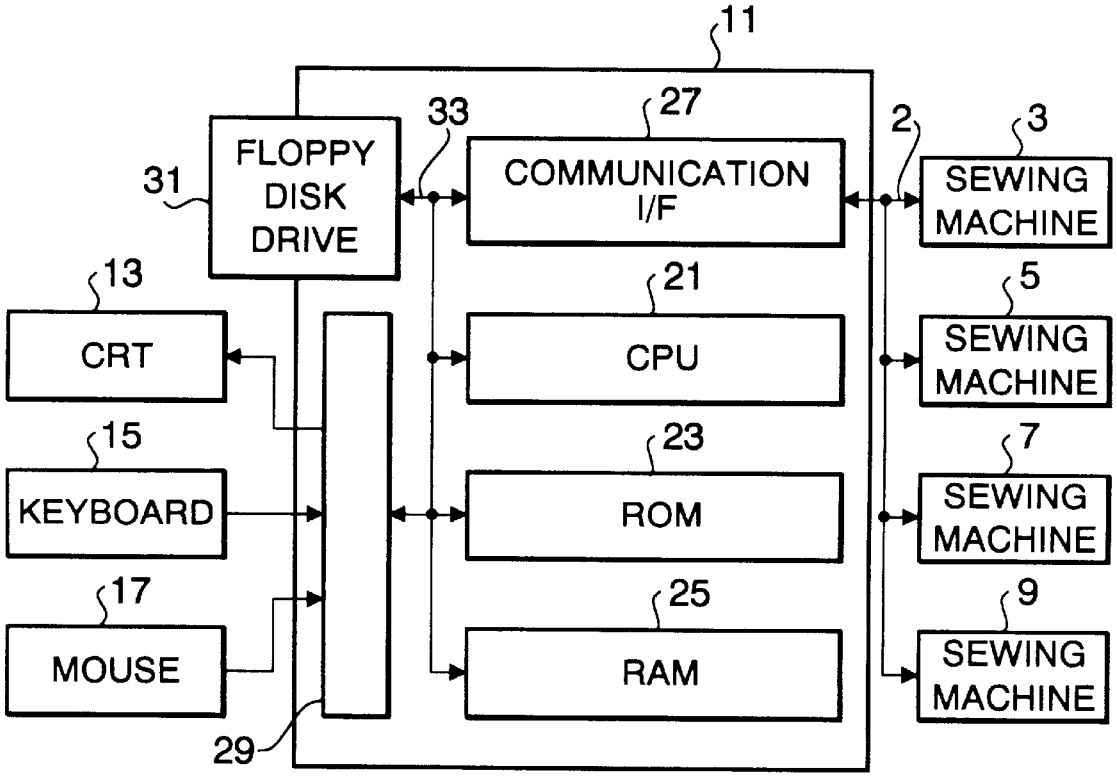
FIG. 2 is a block diagram illustrating a schematic system structure of the embroidery sewing machine control system.

FIG. 2 is a block diagram showing a system configuration of the personal computer 1. As shown in FIG. 2, the personal computer 1 includes a main body 11, a CRT (Cathode Ray Tube) 13, a keyboard 15 and a mouse 17. The main body 11 has a CPU (Central Processing Unit) 21, a ROM (Read Only Memory) 23, a RAM (Random Access Memory) 25, and the like. Further, the main body 11 is provided with a communication interface 27 for communicating with the sewing machines 3, 5, 7 and 9 through the cables 2, an I/O (Input and Output) port 29 for data transmission through the keyboard 15 and the mouse 17, and a floppy disk drive 31 for recording or reading data to or from a floppy disk. The CPU 21, ROM 23, RAM 25, the communication interface 27, the I/O port 29, and the floppy disk driver 31 is capable of transmitting data through a system bus 33.

Figure 3:
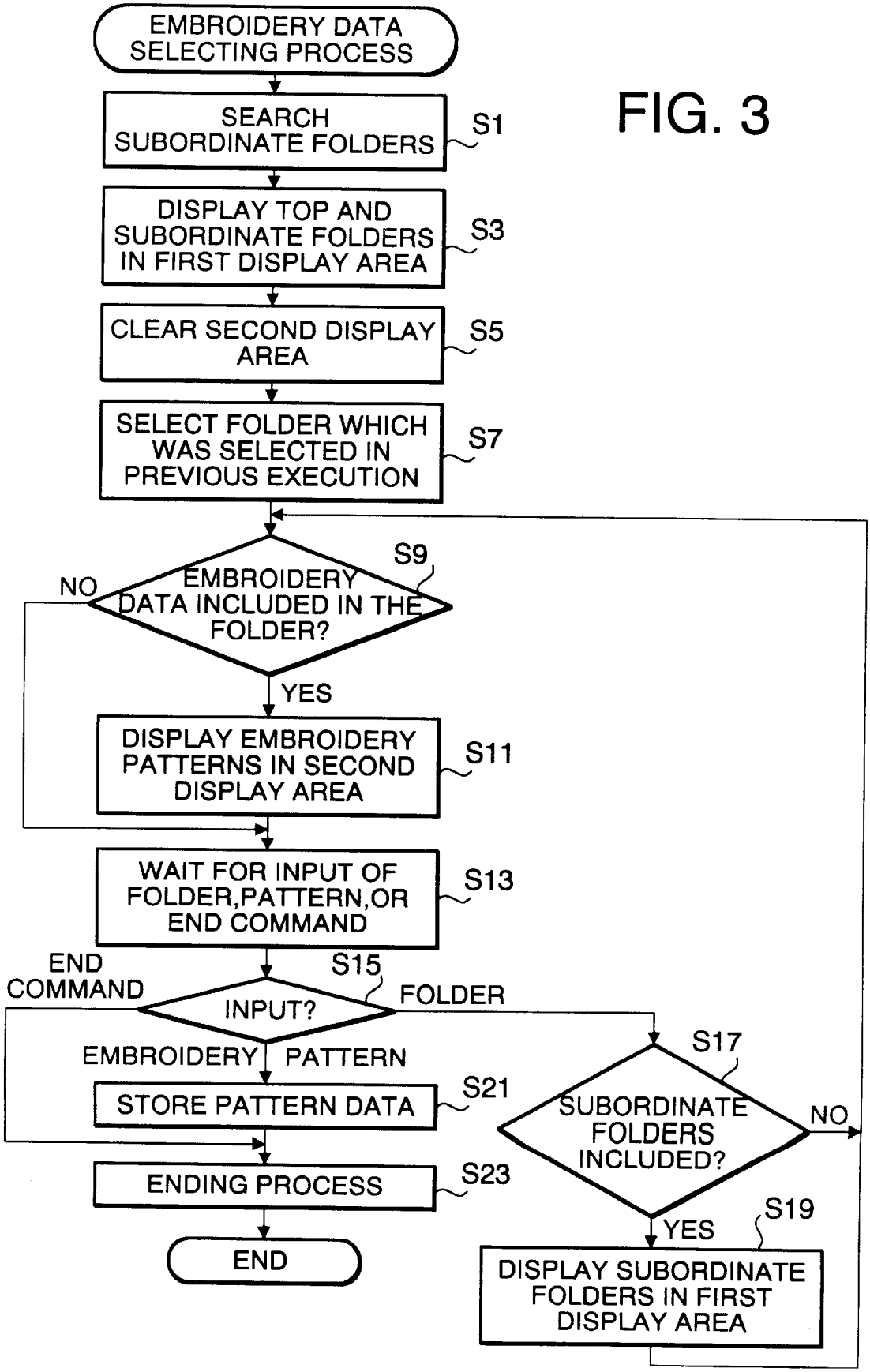
FIG. 3 is a flowchart illustrating an embroidery pattern selecting process.

Embroidery pattern data indicative of embroidery patterns is stored in the floppy disk. If the floppy disk containing the embroidery data is loaded in the floppy disk drive 31, and a predetermined operation command is input through the keyboard 15, the CPU 21, based on a program stored in the ROM 23, executes an embroidery data selecting process, which is shown in FIG. 3 is executed.

The embroidery data selecting process will be described below with reference to FIG. 3. Note that in this example, all the embroidery data is stored in a folder named IMS, and embroidery patterns are, in accordance with an operator's designation, categorized and stored in various sub-folders. In the description below, IMS data corresponds to five folders: a "sports" folder, a "national flags" folder, a "flowers" folder and an "animals" folder. It should be noted that some of the above five folders further include folders indicative of sub-categories. For example, the "sports" folder contains folders for "ball games", "athletics", "swimming", "martialarts", and "others".

When the command is input by the operator, and the CPU 21 starts the embroidery data selecting process, the CPU 21 searches for a subordinate level folder within a hierarchical structure with respect to the top folder. At the initial stage, the IMS data folder is selected as the top folder, and the hierarchically subordinated folders, i.e., the folders of the "sports", "national flags", "others", "flowers", and "animals" are searched at S1.

At S3, a screen 131 of the CRT 13 is divided into a first area 133, which is located on a left-hand side of the screen (see FIG. 4), and a second area 135, which is located on a right-hand side of the screen 131, and a tree structure, i.e., the top folder and the lower level folders subordinate to the top folder are displayed on the first area 133.

Figure 4:
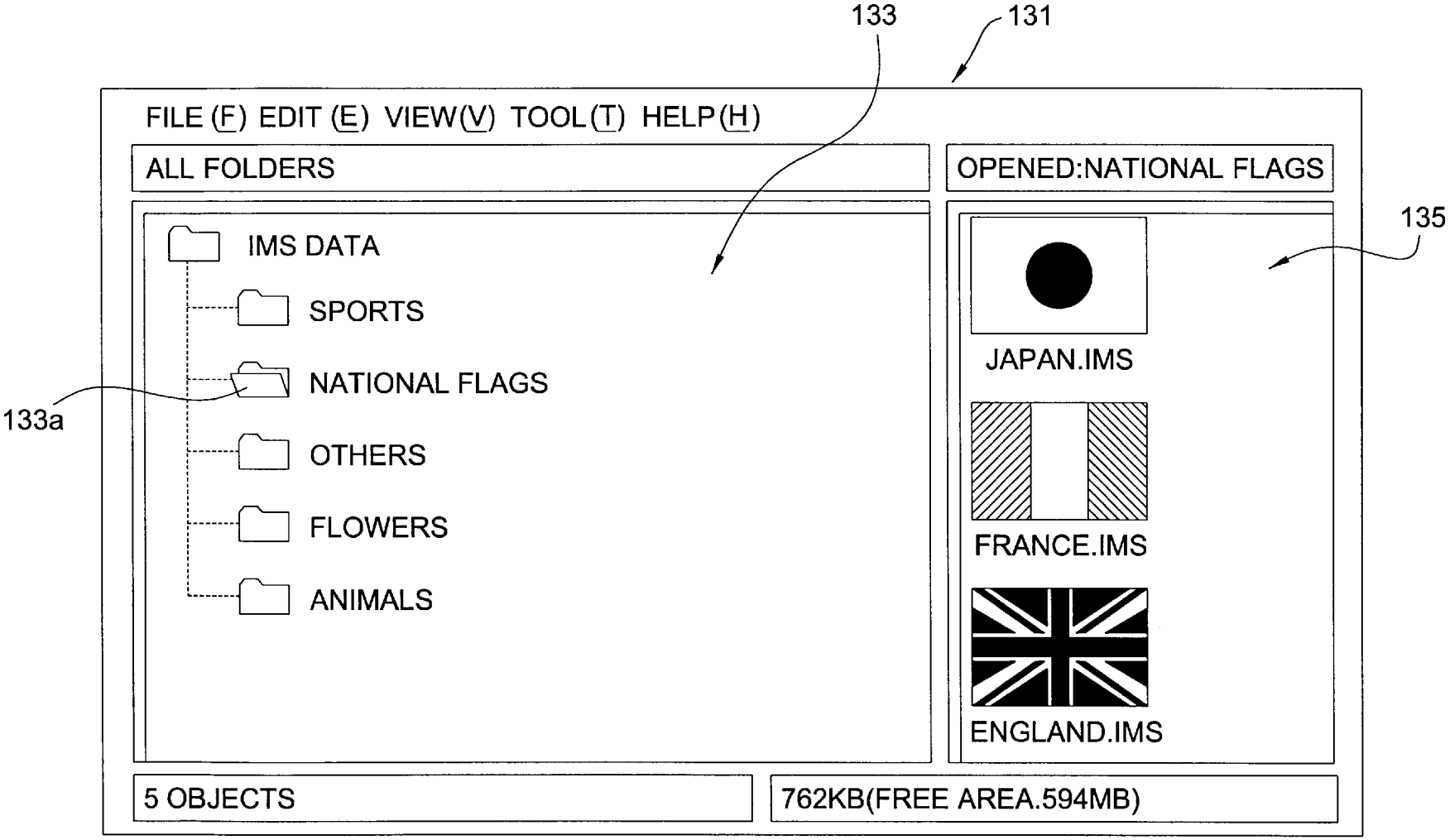
FIG. 4 is an example of a screen image displaying a plurality of folders and a plurality of embroidery patterns.

In S5, the image having been displayed on the second area 135 is cleared. If a folder was selected when the embroidery data selecting process was previously executed, the previously selected folder is selected again in S7, and control goes to S9. It should be noted that, in the initial stage, i.e., when the embroidery data selecting process is executed a first time and no folder has been selected, the IMS data folder is selected at S7. Further, in S7, a picture pattern of a selected folder displayed on the first area 133 is changed as shown in FIG. 4 so as to indicate which folder is currently selected. That is, the picture pattern 133*a* of the selected folder (the "national flags", in this example) looks like a folded file is changed to an opened file, for example.

In step S9, it is determined whether the selected folder includes embroidery data which directly belongs to the selected folder but not in the subordinate folders included in the selected folder. If there is data directly belonging to the selected folder (S9:YES), or if all embroidery data directly belonging to the selected folder, rough images (which will be referred to as the embroidery pattern hereinafter) are displayed on the second area 135 together with the name of the embroidery data (see FIG. 4). For example, if the "national flags" folder is selected in S7, the embroidery patterns of the national flags included in the folder, such as "JAPAN. IMS" is displayed on the second area 135 together with the embroidery pattern therefor (see FIG. 4). Note that if the all the data included in the selected folder cannot be displayed on the second area 135 at a time, scroll can be enabled in response to operation of a scroll key or the like on the keyboard 15, thereby enabling the operator to recognize all the embroidery patterns.

If no embroidery data is directly included in the selected folder (S9:No), or the process of S11 is finished, control goes to S13, and waits for input of a folder, embroidery pattern, or end command. It should be noted that input of folder is done such that a mouse cursor (not shown) is located on one of the folders displayed in the first area 133 by operation of the keyboard 15 or the mouse 17, and click the mouse button. Input of the embroidery pattern is done by locating the cursor on an embroidery pattern displayed in the second area 135, and clicking the mouse button. Input of the end button is done by operating the keyboard in accordance with a predetermined sequence.

In S15, operation branches in accordance with the input command. If a folder is input, control goes to S17. In S17, it is determined whether the folder includes sub-folders, i.e., folders subordinate to the selected folder. If the selected folder does not include a folder (S17:NO), control goes to S9. Then, the above described process is executed with respect to the folder input at S13. If the folder includes sub-folder(s) (S17:YES), the sub-folder(s) are displayed in the first area 133, and control goes to S9. For example, when the "sports" folder is selected, "IMS data" indicated in FIG. 4 is changed such that "sports", "national flags", "others", "flowers" and "animals" are changed to "ball games", "athletics", "swimming", "martialarts" and "others", respectively.

If an embroidery pattern is input at S15, the embroidery pattern data (all data related to the embroidery pattern) is stored in a predetermined storage area of the RAM 25. Then an end process is executed at S23, and the process is terminated.

If input of the end command is detected at S15, control directly goes to S23 to execute the end process. The end process is a general ending sequence which includes, for example, a process of closing the image display window 131. It should be noted that, when the embroidery pattern data is stored in the RAM 25 in S21, if the keyboard 15 is operated in accordance with a predetermined order to input an embroidery starting command, the CPU 21 executes a sewing machine driving process for driving the sewing machines 3, 5, 7 and 9 in accordance with the stored embroidery data (mainly with a stitch data thereof). If a command instructing display of the embroidery pattern through the keyboard 15 is detected at S15, the CPU 21 executes an embroidery pattern displaying process for displaying a detailed (minute) image of the embroidery pattern on the CRT 13 in accordance with the embroidery data. The detailed image may be, for example, displayed on another window which may be opened when the command is detected. In such a case, when the newly opened window is closed, the first and second areas may be displayed again, and the operator may continue selection.

Alternatively, by modifying the above process to wait for operation of the keyboard 15 after S21 is finished, transition to the sewing machine driving process or the embroidery pattern display process could be done without terminating the selecting process of FIG. 3. In such a case, the process could further be changed such that after the sewing machine driving process or the embroidery pattern display process is finished, control goes to S9 of FIG. 3. According to this alternative, data selection can be continued if the sewed pattern or displayed pattern is different from the operator's intention and the operator is capable of making further attempts.

As described above, according to an embodiment of the invention, the screen 131 is divided in to two areas: the first and second areas. The tree structure of the folders is displayed in the first area 133, and the embroidery pattern of the selected folder is displayed in the second area 135. Accordingly, the operator is capable of visually selecting a desired one of embroidery patterns which are included in the selected folder. If the operator could not find the desired pattern, the operator can make a selection with respect to one of the folders included in a tree structure. Further, if the selected folder includes sub-folders, the sub-folders are displayed in the first area 133. Therefore, the operator can finally find a desired pattern by tracing the tree structure and opens the folders one by one. Since the embroidery patterns are categorized and put into corresponding folders, and the folders are also categorized, the operator can find a pattern easily and efficiently, even if a great number of embroidery patterns are included.

Further, according to the system described above, the detailed pattern can also be displayed, and accordingly the operator can recognize the detail of the pattern, and/or form the embroidery.

The present invention is not restricted to the above-described embodiment, but may be embodied in various other forms without departing from the spirit or essential characteristic thereof. For example, in the embodiment described above, the embroidery patterns are categorized in accordance with concept represented by the pattern. However, in a sewing machine control system for commercial use, it may be advantageous that the embroidery patterns are divided based on customers therefor. Further, in the embodiment, the first and second areas are arranged in right and left directions in FIG. 4. The first and second areas could be replaced, and/or could be changed such that the first and second areas are arranged in upper and lower areas in the image screen 131. Further, the ratio of the first area to the second area could be set to any ratio. Furthermore, as a recording medium containing the embroidery data, a hard disk, a CD-ROM or the like could be used instead of, or in addition to the floppy disk.

Still further, in the embodiment, if the embroidery patterns cannot be displayed in the second area at a time, the screen image should be scrolled. As an alternative, this can be changed such that the size of the image of the patterns to be shown in the second area are reduced so that all the patterns are displayed in the second area at a time. In this case, it may be advantageous if one or some of the patterns displayed as reduced can be designated and a magnified image thereof can be displayed if necessary.

What is claimed is:

1. An embroidery data selecting system for selecting an embroidery pattern from a plurality of embroidery patterns, said system comprising:

a recording medium which stores said plurality of embroidery patterns;

a display having at least a first display area and a second display area;

a first display controller which displays in said first display area a plurality of groups, said plurality of embroidery patterns being categorized into said plurality of groups, said plurality of groups being organized in a tree data structure such that said plurality of groups are linked together in a hierarchical fashion, said tree data structure being visually recognizable in said first display area;

a manually operable member which can be operated to select a group displayed in said first display area; and a second display controller which, in response to operation of said manually operable member to select a group displayed in said first display area, displays in said second display area embroidery patterns included in said selected group, said plurality of groups and said embroidery patterns included in said selected group being displayed simultaneously.

2. The embroidery data selecting system according to claim 1, wherein any one of said embroidery patterns can be selected by said manually operable member, and wherein a detailed image of a selected any one of said embroidery patterns is displayed on said display.

3. The embroidery data selecting system according to claim 1, wherein each group is displayed as a folder.

4. The embroidery data selecting system according to claim 1, wherein at least one of said plurality of groups includes at least one subordinate group, said at least one subordinate group being displayed in said first display area when said at least one of said plurality of groups is selected by operation of said manually operable member.

5. The embroidery data selecting system according to claim 1, further comprising a memory, and wherein a any one of said selected embroidery patterns is read out of said recording medium and stored in said memory.

6. The embroidery data selecting system according to claim 1, wherein said recording medium comprises a floppy disk.

7. The embroidery data selecting system according to claim 1, wherein said manually operable member comprises a mouse.

8. The embroidery data selecting system according to claim 1, wherein said manually operable member comprises a keyboard.

9. An embroidery data selecting system for selecting an embroidery pattern from a plurality of embroidery patterns, said system comprising:

a recording medium which stores said plurality of embroidery patterns, said plurality of embroidery patterns being categorized into a plurality of groups, said plurality of groups being organized in a tree data structure such that said plurality of groups are linked together in a hierarchical fashion;

a display having at least a first display area and a second display area;

a first display controller which displays said plurality of groups in said first display area such that said tree data structure is visually recognizable in said first display area;

a manually operable member which can be operated to select a group displayed in said first display area; and a second display controller which, in response to operation of said manually operable member to select a group displayed in said first display area, displays in said second display area embroidery patterns included in said selected group, said plurality of groups and said embroidery patterns included in said selected group being displayed simultaneously.

10. An embroidery sewing machine control system for selecting one of a plurality of embroidery patterns and controlling at least one sewing machine to form an embroidery based on a selected one of said plurality of embroidery patterns, said embroidery sewing system comprising:

a recording medium which stores said plurality of embroidery patterns, said plurality of embroidery patterns being categorized into a plurality of groups, said plurality of groups being organized in a tree data structure such that said plurality of groups are linked together in a hierarchical fashion;

a display having at least a first display area and a second display area;

a first display controller which displays said plurality of groups in said first display area such that said tree data structure is visually recognizable in said first display area;

a manually operable member which can be operated to select a group displayed in said first display area;

a second display controller which, in response to operation of said manually operable member to select a group displayed in said first display area, displays in said second display area embroidery patterns included in said selected group, said plurality of groups and said embroidery patterns included in said selected group being displayed simultaneously; and an embroidery sewing controller which controls said at least one sewing machine to form an embroidery based on a selected one of said plurality of embroidery patterns selected by said manually operable member.

11. The embroidery sewing machine control system according to claim 10, wherein any one of said embroidery patterns can be selected by said manually operable member, and wherein a detailed image of a selected any one of said embroidery patterns is displayed on said display.

12. The embroidery sewing machine control system according to claim 10, wherein each group is displayed as a folder. said hierarchical structure among said plurality of groups.

13. The embroidery sewing machine control system according to claim 10, wherein at least one of said plurality of groups includes at least one subordinate group, said at least one subordinate group being displayed in said first display area when said at least one of said plurality of groups is selected by operation of said manually operable member.

14. The embroidery sewing machine control system according to claim 10, further comprising a memory, and wherein a selected any one of said embroidery patterns is read out of said recording medium and stored in said memory.

15. The embroidery sewing machine control system according to claim 10, wherein said recording medium comprises a floppy disk.

16. The embroidery sewing machine control system according to claim 10, wherein said manually operable member comprises a mouse.

17. The embroidery sewing machine control system according to claim 10, wherein said manually operable member comprises a keyboard.

18. The embroidery sewing machine control system according to claim 10, wherein a displayed condition, as viewed in said first display area, of any one of said plurality of groups is changed when it is selected by operation of said manually operable member.

19. An embroidery sewing machine control system for selecting one of a plurality of embroidery patterns and controlling at least one sewing machine to form an embroidery based on a selected one of said plurality of embroidery patterns, said embroidery sewing system comprising:

a recording medium which stores said plurality of embroidery patterns, said plurality of embroidery patterns being categorized into a plurality of groups, said plurality of groups being organized in a tree data structure such that said plurality of groups are linked together in a hierarchical fashion, and wherein at least one of said plurality of groups includes at least one subordinate group;

a display having at least a first display area and a second display area;

a first display controller which displays said plurality of groups in said first display area such that said tree data structure is visually recognizable in said first display area;

a manually operable member which can be operated to select a group displayed in said first display area, said first display controller displaying said at least one subordinate group in said first display area when said manually operable member is operated to select said at least one of said plurality of groups;

a second display controller which, in response to operation of said manually operable member to select a group displayed in said first display area, displays in said second display area embroidery patterns included in said selected group, said plurality of groups and said embroidery patterns included in said selected group being displayed simultaneously; and an embroidery sewing controller which controls said at least one sewing machine to form an embroidery based on a selected one of said plurality of embroidery patterns selected by said manually operable member.

* * * * *